US008461770B2

(12) United States Patent
Ye et al.

(10) Patent No.: US 8,461,770 B2
(45) Date of Patent: Jun. 11, 2013

(54) LIGHT-EMITTING DIODE DRIVER

(75) Inventors: Kyung Hee Ye, Ansan-si (KR); Hyun Gu Kang, Ansan-si (KR); Dae Sung Kal, Ansan-si (KR); Won Cheol Seo, Ansan-si (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 267 days.

(21) Appl. No.: 12/704,881

(22) Filed: Feb. 12, 2010

(65) Prior Publication Data

US 2010/0244727 A1 Sep. 30, 2010

(30) Foreign Application Priority Data

Mar. 25, 2009 (KR) ..... 10-2009-0025361

(51) Int. Cl.
*H05B 37/02* (2006.01)

(52) U.S. Cl.
USPC ..... 315/291; 315/186; 315/188; 315/200 R; 315/224

(58) Field of Classification Search
USPC ..... 315/186, 187, 188, 200 R, 224, 227 R, 315/291
See application file for complete search history.

(56) References Cited

U.S. PATENT DOCUMENTS 6,614,672 B2 * 9/2003 Shona ..... 363/89
6,768,273 B2 * 7/2004 Uno ..... 315/291
7,696,700 B2 * 4/2010 Li ..... 315/185 R
2004/0189555 A1 * 9/2004 Capen et al. ..... 345/82
2008/0247207 A1 * 10/2008 Li ..... 363/126
2008/0252229 A1 * 10/2008 Wu ..... 315/227 R
2010/0148694 A1 * 6/2010 Chang et al. ..... 315/294

FOREIGN PATENT DOCUMENTS

JP 2008-100629 5/2008
JP 3148847 12/2009
KR 10-0440184 7/2004

OTHER PUBLICATIONS

P. M. Lin and Leon O. Chua, "Topological Generation and Analysisof Voltage Multiplier Circuits," IEEE Transactions on Circuits and Systems, vol. Cas-24, No. 10, Oct. 1977.*
P.M Lin and Leon O. Chua, "Topological Generation and Analysis of Voltage Multiplier Circuits," IEEE Transactions on Circuits and Systems, vol. Cas-24, No. 10, Oct. 1977.*

* cited by examiner

*Primary Examiner* — Douglas W Owens
*Assistant Examiner* — Thai Pham
(74) *Attorney, Agent, or Firm* — H.C. Park & Associates, PLC

(57) ABSTRACT

A light-emitting diode (LED) driver used to power at least one LED with an alternating current (AC) voltage source is provided. The LED driver includes a rectifying unit applying N-fold higher voltage than the voltage from the AC voltage source to the LED. The rectifying unit includes a first charging unit to charge a first voltage, and a second charging unit to charge a second voltage. The first voltage includes the voltage at the AC voltage source during a first half-cycle of one AC voltage cycle, and the second voltage includes the first voltage and the voltage at the AC voltage source during the second half-cycle of the AC voltage cycle. Accordingly, the LED driver may improve light-emitting efficiency and reduce flicker of LEDs.

16 Claims, 2 Drawing Sheets

LIGHT-EMITTING DIODE DRIVER

CROSS REFERENCE TO RELATED APPLICATION

This application claims priority from and the benefit of Korean Patent Application No. 10-2009-0025361, filed on Mar. 25, 2009, which is hereby incorporated by reference for all purposes as if fully set forth herein

BACKGROUND OF THE INVENTION

1. Field of the Invention

Exemplary embodiments of the present invention relate to a light-emitting diode (LED) driver and, more particularly, to an LED driver to power LEDs with an alternating current (AC) voltage source without an AC/DC converter.

2. Discussion of the Background

A light-emitting diode (LED) is a semiconductor light source, which is turned on is at a forward-bias threshold voltage or higher when the LED is forward-biased. Further, an anti-parallel LED pair may be used to extend an operating region when an AC voltage source is applied. The anti-parallel LED pair may operate during the positive half-cycle and the negative half-cycle of the AC voltage source. In this case, one of the anti-parallel LED pair is forward-biased at a forward-bias threshold voltage or higher during the positive half-cycle of the AC voltage source, and the other of the anti-parallel LED pair is forward-biased at a forward-bias threshold voltage or higher during the negative half-cycle of the AC voltage source. This mode of operating the anti-parallel LED pair may cause the LEDs to have a low light-emitting efficiency of 50% or less or to suffer severe flicker.

In addition, since LEDs are turned on at a forward-bias threshold voltage or higher, LEDs other than the anti-parallel LED pair may require an additional AC/DC converter. Thus, designing an LED driver with the additional AC/DC converter may lead to increased costs and a more complex circuit configuration. Further, a conventional solution using only a rectifier circuit or smoothing circuit may limit the number of LEDs connected in series. Accordingly, an LED driver that solves these problems is needed.

SUMMARY OF THE INVENTION

Additional features of the invention will be set forth in the description which follows, and in part will be apparent from the description, or may be learned by practice of the invention.

Exemplary embodiments of the present invention disclose a light-emitting diode (LED) driver to power at least one LED comprising a rectifying unit to apply a voltage from an alternating current (AC) voltage source to the at least one LED. The rectifying unit comprises a is first charging unit to charge a first voltage and a second charging unit to charge a second voltage. The first voltage comprises the voltage of the AC voltage source during a first half-cycle of one AC voltage cycle, and the second voltage comprises the first voltage and the voltage of the AC voltage source during the second half-cycle of the AC voltage cycle.

Exemplary embodiments of the present invention also disclose an LED driver comprising a first group of m capacitors connected in series through a first group of m+1 nodes, m being a positive integer; a second group of n capacitors connected in series through a second group of n+1 nodes, n being a positive integer; an AC voltage source connected between a first node of the first group of nodes and a first node of the second group of nodes; and m+n branches. Each branch is connected between one node of the first group of nodes and one node of the second group of nodes and comprises at least one rectifier. The LED driver drives at least one LED with the AC voltage source, and the LED is connected across one or more capacitors of the first group of capacitors or across one or more capacitors of the second group of capacitors.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
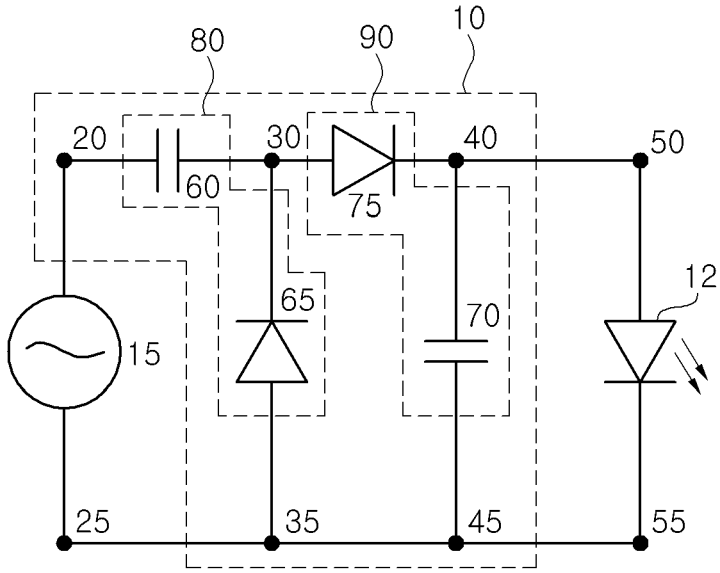
FIG. 1 shows an equivalent circuit diagram of an LED driver according to an is exemplary embodiment of the present invention.

The invention is described more fully hereinafter with reference to the accompanying drawings, in which exemplary embodiments of the invention are shown. This invention, however, may be embodied in many different forms and should not be construed as limited to the exemplary embodiments set forth herein. Rather, these exemplary embodiments are provided so that this disclosure is thorough and will fully convey the scope of the invention to those skilled in the art. In the drawings, the size and relative sizes of layers and regions may be exaggerated for clarity. Like reference numerals in the drawings denote like elements.

Hereinafter, exemplary embodiments of the present invention are described in detail with reference to the accompanying drawings.

FIG. 1 shows an equivalent circuit diagram of an LED driver according to an exemplary embodiment of the present invention.

Referring to FIG. 1, an LED driver to power at least one LED 12 with an AC voltage source 15 includes a voltage-doubler rectifying unit 10 to rectify and to double the voltage of the AC voltage source 15. In this case, the LED driver may power two or more LEDs 12.

Although a single LED 12 is shown in FIG. 1, the number of LEDs is not limited thereto. Since the doubled voltage is applied across the node 50 and the node 55 by the voltage-doubler rectifying unit 10, a greater number of LEDs may be connected to the circuit as compared to when a non-doubled, rectified DC voltage is applied.

The voltage-doubler rectifying unit 10 includes a first charging unit 80 and a second charging unit 90. The first charging unit 80 charges a first voltage, and the second charging unit 90 charges a second voltage. The first voltage includes the voltage at the AC voltage source 15 during a first half-cycle of one AC voltage cycle, and the second voltage includes the first voltage and the voltage at the AC voltage source 15 during the second half-cycle of the one AC voltage cycle.

The first charging unit 80 includes a first capacitor 60 and a first rectifying diode 65 connected in series between the node 20 and the node 25 of the AC voltage source 15.

The second charging unit 90 includes a second rectifying diode 75 and a second capacitor 70 connected in series to each other. With respect to the node 20 and the node 25, the second charging unit 90 is connected in parallel to the first rectifying diode 65 and connected in series to the first capacitor 60.

The LED 12 is connected across the second capacitor 70 and is driven with the second voltage.

In the first charging unit 80 and the second charging unit 90, the first rectifying diode 65 and the second rectifying diode 75 may be reversely connected. More specifically, although the first rectifying diode 65 is forward-biased from the node 35 to the node 30 and the second rectifying diode 75 is forward-biased from the node 30 to the node 40 in FIG. 1, the first rectifying diode 65 may be connected as to be forward-biased from the node 30 to the node 35, and the second rectifying diode 75 may be connected to be forward-biased from the node 40 to the node 30. Since the polarity of the voltage charged to the second capacitor 70 is correspondingly reversed, the LED 12 is reversely connected accordingly.

Further, each of the first and second rectifying diodes 65 and 75 may be one or more LEDs. In this case, the LEDs may be connected in series, in parallel, in series and parallel, or in a combination thereof to correspond to the polarities of the first and second capacitors 60 and 70.

Since the doubled DC voltage may be applied to the LED 12 without an additional AC/DC converter, the low light-emitting efficiency (less than 50%) and severe flicker may be improved as compared with an anti-parallel LED pair directly connected to the AC voltage source.

Figure 2:
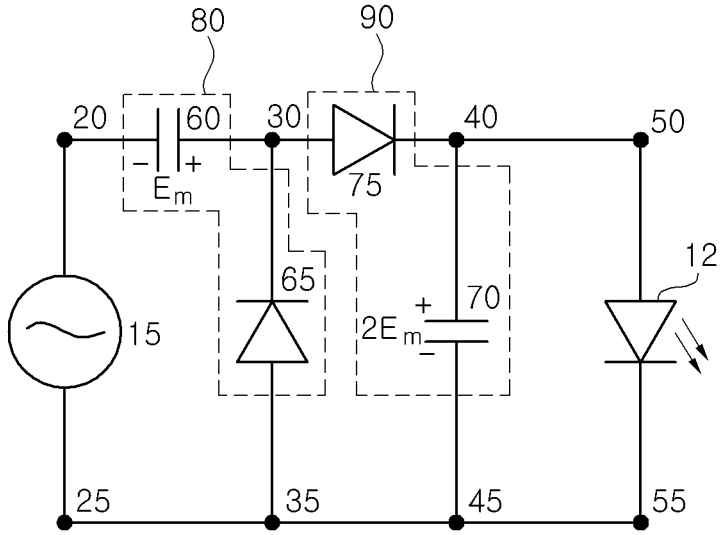
FIG. 2 shows a process of charging the LED driver whose circuit diagram is shown in FIG. 1.

FIG. 2 shows a process of charging the LED driver whose circuit diagram is shown in FIG. 1. In FIG. 2, the peak voltage of the AC voltage source 15 is $E_m$ as shown at the first capacitor 60.

During a negative half-cycle of the AC voltage source 15, only the first rectifying diode 65 is turned on. Thus, a current flows through the node 25, the node 35, the first rectifying diode 65, the node 30, the first capacitor 60, and the node 20. In this case, the first capacitor 60 is charged with the voltage $E_m$. The voltage $E_m$ of the first capacitor 60 is positive at the node 30 and negative at the node 20 as shown in FIG. 2.

During a positive half-cycle of the AC voltage source 15, the first rectifying diode 65 is turned off, and the second rectifying diode 75 is turned on. Thus, a current flows through the node 20, the first capacitor 60, the node 30, the second rectifying diode 75, the node 40, the second capacitor 70, and the nodes 45, 35, and 25. In this case, the second capacitor 70 is is charged with both the voltage $E_m$ of the first capacitor 60 and the voltage of the positive half-cycle at the AC voltage source 15. Thus, a voltage 2 $E_m$ is charged to the second capacitor 70. The voltage 2 $E_m$ of the second capacitor 70 is positive at the node 40 and negative at the node 45 as shown in FIG. 2.

In short, during the positive half-cycle of the AC voltage source 15, the second capacitor 70 is charged, and the charged voltage 2 $E_m$ is applied to the LED 12. On the other hand, during the negative half-cycle of the AC voltage source 15, the second capacitor 70 discharges the voltage 2 $E_m$ charged during the positive half-cycle. In this case, since the discharge period of the second capacitor 70 is long compared with the period of the AC voltage source 15, the voltage applied to the LED 12 becomes effectively a DC voltage.

As described above, if the first and second rectifying diodes 65 and 75 are reversely connected, the polarity of the voltage charged to the second capacitor 70 is reversed, and the LED 12 must be reversely connected accordingly.

Although FIGS. 1 and 2 show the LED driver as a half-wave voltage-doubler rectifier circuit, various drivers for supplying a DC voltage to the LED 12 without an additional AC/DC converter may be employed. For example, instead of the half-wave voltage-doubler rectifier circuit, a full-wave voltage-doubler rectifier circuit, a voltage-tripler rectifier circuit, or a voltage-quadrupler rectifier circuit may be employed.

Figure 3:
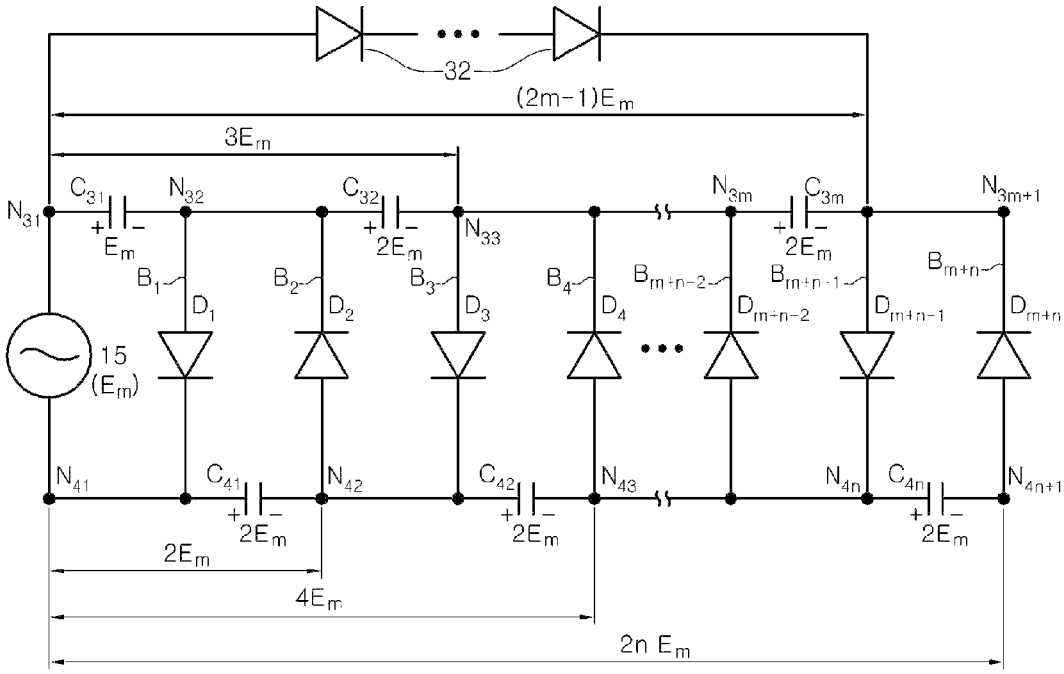
FIG. 3 shows an equivalent circuit diagram of an LED driver including an N-fold voltage multiplier rectifier circuit (N being an integer of 2 or greater) according to an exemplary embodiment of the present invention.

FIG. 3 shows an equivalent circuit diagram of an LED driver including an N-fold voltage multiplier rectifier circuit (N being an integer of 2 or greater) according to an exemplary embodiment of the present invention.

Referring to FIG. 3, the LED driver includes a first group of m capacitors $C_{31}$, $C_{32}$, . . . , $C_3$ m, a second group of n capacitors $C_{41}$, $C_{42}$, . . . , $C_{4n}$, and m+n branches $B_1$, $B_2$, . . . , $B_{m+n}$.

The first group of capacitors $C_{31}, C_{32}, \ldots, C_{3m}$ is connected in series through a first group of m+1 nodes $N_{31}, N_{32}, \ldots$, and $N_{3(m+1)}$, m being a positive integer. The second group of capacitors $C_{41}, C_{42}, \ldots, C_{4n}$ is connected in series through a second group of n+1 nodes $N_{41}, N_{42}, \ldots$, and $N_{4(n+1)}$, n being a positive integer. As shown in FIG. 3, m may be equal to n or be one greater than n.

Each of the branches $B_1$, $B_2$, . . . , $B_{m+n}$ is connected between one node of the first group of nodes $N_{31}$, $N_{32}$, . . . , $N_{3(m+1)}$ and one node of the second group of nodes $N_{41}$, $N_{42}$, . . . , $N_{4(n+1)}$. For example, the branch $B_1$ is connected between the node $N_{32}$ and the node $N_{41}$, and the branch $B_2$ is connected between the node $N_{32}$ and the node $N_{42}$.

Even-numbered branches $B_2$, $B_4$, . . . of the branches $B_1$, $B_2$, . . . , and $B_{m+n}$ include rectifiers $D_2$, $D_4$, . . . to flow current from the a-th nodes of the second group of nodes $N_{41}$, $N_{42}$, . . . , and $N_{4(n+1)}$ to the a-th nodes of the first group of nodes $N_{31}, N_{32}, \ldots$, and $N_{3(m+1)}$, where "a" is 2, 3, n, and n+1.

Odd-numbered branches $B_1$, $B_3$, . . . of the branches $B_1$, $B_2$, . . . , and $B_{m+n}$ include rectifiers $D_1$, $D_3$, . . . to flow current from the b-th nodes of the first group of nodes $N_{31}$, $N_{32}$, . . . , and $N_{3(m+1)}$ to the (b−1)-th nodes of the second group of nodes $N_{41}, N_{42}, \ldots$, and $N_{4(n+1)}$, where "b" is 2, 3, . . . , m−1, and m.

In the LED driver according to exemplary embodiments of the present invention, the AC voltage source 15 is supplied between the first node $N_{31}$ of the first group of nodes and the first node $N_{41}$ of the second group of nodes. The peak voltage of the AC voltage source 15 is $E_m$.

An LED may be connected in parallel to one or more capacitors of the first group is of capacitors or may be connected in parallel to one or more capacitors of the second group of capacitors. For example, when an LED is connected across the capacitors $C_{31}$ and $C_{32}$, i.e., between the node $N_{31}$ and the node $N_{33}$, a three-fold rectified voltage 3 $E_m$ may be applied to the LED as shown in FIG. 3. Alternatively, when an LED is connected across the capacitors $C_{41}$ and $C_{42}$ between the node $N_{41}$ and the node $N_{43}$, a four-fold rectified voltage 4 $E_m$ may be applied to the LED as shown in FIG. 3. This application of multiplied voltage to an LED may be generalized to the first group of capacitors and the second group of capacitors. More specifically, when the LED 32 is connected in parallel to the first to m-th capacitors of the first group, a (2m−1)-fold rectified voltage of amplitude $(2m-1)\times E_m$ is applied to the LED 32. Similarly, when an LED (not shown) is connected in parallel to the first n-th capacitors of the second group, a 2n-fold rectified voltage of amplitude $(2n)\times E_m$ is applied to the LED. In this case, instead of a single LED, a plurality of LEDs may be connected in series, in parallel, or in series and parallel to the LED driver.

Further, although one of the diodes $D_1, D_2, \ldots$, and $D_{m+n}$ is located on each branch $B_1, B_2, \ldots$, and $B_{m+n}$, a plurality of diodes may be connected in series, in parallel, in series and parallel, or a combination thereof for rectification purposes. Further, some or all of the rectifying diodes may be LEDs.

As described above, the LED driver may improve light-emitting efficiency and reduces flicker. Further, the LED driver may be simply implemented and reduces design costs since AC/DC converters are eliminated. Additionally, the LED driver may substantially increase the number of LEDs connected in series to each other.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A light-emitting diode (LED) driver to power at least one LED, comprising:

a rectifying unit to apply a voltage from an alternating current (AC) voltage source to the at least one LED, wherein the rectifying unit comprises:

a first charging unit to charge a first voltage on a first capacitor; and a second charging unit to charge a second voltage on a second capacitor, wherein the first voltage comprises the voltage of the AC voltage source during a first half-cycle of one AC voltage cycle, and the second voltage comprises the first voltage and the voltage of the AC voltage source during the second half-cycle of the AC voltage cycle;

wherein the LED driver is configured to support a DC current flowing from a first terminal of the second capacitor through the at least one LED and further to a second terminal of the second capacitor.

2. The LED driver according to claim 1, wherein the rectifying unit supplies an N-fold higher voltage than the AC voltage source to the LED, wherein N is an integer of two or more.

3. The LED driver according to claim 1, wherein the first charging unit is connected across the AC voltage source and comprises a first capacitor and a first rectifier, wherein the first capacitor and the first rectifier are connected in series to each other.

4. The LED driver according to claim 3, wherein the second charging unit is connected in parallel to the first rectifier and is connected in series to the first capacitor with respect to the AC voltage source, and the second charging unit comprises a second rectifier and a second capacitor, wherein the second capacitor and the second rectifier are connected in series to each other.

5. The LED driver according to claim 4, wherein the at least one LED is connected across the second capacitor and is driven with the second voltage.

6. The LED driver according to claim 4, wherein the first rectifier or the second rectifier comprises at least one LED.

7. The LED driver according to claim 5, wherein the first rectifier or the second rectifier comprises at least one LED.

8. A light-emitting diode (LED) driver, comprising:

a first group of m capacitors connected in series through a first group of m+1 nodes, m being a positive integer;

a second group of n capacitors connected in series through a second group of n+1 nodes, n being a positive integer;

an AC voltage source connected between a first node of the first group of nodes and a first node of the second group of nodes; and m+n branches, wherein each branch is connected between one node of the first group of nodes and one node of the second group of nodes, wherein each branch comprises at least one rectifier, and wherein the LED driver drives at least one LED with the AC voltage source, and the LED is connected across one or more capacitors of the first group of capacitors or across one or more capacitors of the second group of capacitors.

9. The LED driver according to claim 8, wherein the rectifier of each even-numbered branch is connected to flow current from an a-th node of the second group of nodes to an a-th node of the first group of nodes, and the rectifier of each odd-numbered branch is connected to flow current from a b-th node of the first group of nodes to a (b−1)-th node of the second group of nodes, and wherein "a" is 2, 3, . . . , n, and n+1; and "b" is 2, 3, . . . , m−1, and m.

10. The LED driver according to claim 8, wherein the rectifier comprises at least one LED.

11. The LED driver according to claim 9, wherein the rectifier comprises at least one LED.

12. A light-emitting diode (LED) driver to power at least one LED comprising: a first rectifier, a second rectifier, a first capacitor, a second capacitor; a first input terminal, and a second input terminal;

wherein the first input terminal and the second input terminal are configured to receive an AC voltage;

wherein the first input terminal is connected to the first capacitor and the second input terminal is connected to a first node;

wherein the first capacitor has a terminal connected to the first input terminal and another terminal connected to a second node;

wherein the first rectifier has a terminal connected to the first node and another terminal connected to the second node;

wherein the second rectifier has a terminal connected to the second node and another terminal connected to a third node;

wherein the second capacitor has a terminal connected to the first node and another terminal connected to the third node;

wherein the at least one LED is connected to the first node and the third node;

wherein the LED driver is configured such that, during a positive half-cycle of an AC voltage applied between the first input terminal and the second input terminal, the voltage between the first node and the third node is substantially twice the peak voltage of the AC voltage.

13. The LED driver according to claim 12, wherein the discharge period of the second capacitor is longer than the AC voltage cycle.

14. The LED driver according to claim 8, wherein the at least one LED is directly connected across one or more capacitors of the first group of capacitors or across one or more capacitors of the second group of capacitors.

15. The LED driver according to claim 8, wherein the discharge period of the capacitors in the first group of capacitors and in the second group of capacitors is longer than the AC voltage cycle.

16. The LED driver according to claim 8, wherein the LED is connected to two nodes of the first group of nodes.

* * * * *